United States Patent [19]

Murayama et al.

[11] Patent Number: 4,734,748

[45] Date of Patent: Mar. 29, 1988

[54] AUXILIARY MACHINE SUPPORTING STRUCTURE FOR IMAGE FORMING APPARATUS

[75] Inventors: Toshiaki Murayama, Tokyo; Kazumi Umezawa, Yokohama, both of Japan

[73] Assignee: Canon Kabushiki Kaisha, Tokyo, Japan

[21] Appl. No.: 27,307

[22] Filed: Mar. 18, 1987

[30] Foreign Application Priority Data

| | | | |
|---|---|---|---|
| Mar. 20, 1986 | [JP] | Japan | 61-63455 |
| Mar. 28, 1986 | [JP] | Japan | 61-70173 |
| Mar. 28, 1986 | [JP] | Japan | 61-70174 |
| Jun. 9, 1986 | [JP] | Japan | 61-133560 |

[51] Int. Cl.[4] ..... G03G 15/00

[52] U.S. Cl. ..... 355/14 SH; 355/3 SH; 271/287; 271/292; 271/294

[58] Field of Search ..... 355/14 SH, 3 SH, 3 R, 355/14 R; 271/287–289, 292, 293, 294, 297

[56] References Cited

U.S. PATENT DOCUMENTS

| | | | |
|---|---|---|---|
| 4,520,977 | 6/1985 | Holzhauser et al. | 355/14 SH X |
| 4,561,765 | 12/1985 | Masuda | 355/14 SH |
| 4,585,333 | 4/1986 | Yamagishi | 355/14 SH X |
| 4,627,706 | 12/1986 | Takahashi et al. | 355/14 SH |
| 4,655,582 | 4/1987 | Okuda et al. | 355/14 R |

*Primary Examiner*—A. C. Prescott

*Attorney, Agent, or Firm*—Fitzpatrick, Cella, Harper & Scinto

[57] ABSTRACT

A device for separably supporting an auxiliary machine to an image forming apparatus, including supporting structure for supporting the auxiliary machine and for allowing the auxiliary machine to move up and down between an operative position wherein the auxiliary machine is cooperable with the image forming machine and a retracted position wherein said auxiliary machine is retracted from the operative position, and means for retaining the auxiliary machine at the operative position.

18 Claims, 19 Drawing Figures

AUXILIARY MACHINE SUPPORTING STRUCTURE FOR IMAGE FORMING APPARATUS

FIELD OF THE INVENTION AND RELATED ART

The present invention relates to an auxiliary machine supporting structure for supporting auxiliary machines in an image forming apparatus, such as a sorter attached to a main apparatus, that is, a copying machine or the like, more particularly to such a structure for releasably or detachably supporting it.

The following description will be made with a sorter as an example of the auxiliary machine used in a copying apparatus as an example of the image forming apparatus. However, the present invention is not limited to those examples, and is applicable to another auxiliary machine such as a collator, a finisher (folding and/or binding) or the like used with another image forming apparatus such as a printer, a laser beam printer or the like. Those auxiliary machines will be explained as being attached to a print discharging side of the image forming apparatus, but the present invention is applicable to auxiliary machines attached to a recording material supplying side.

Those auxiliary machines are required to be separated from the image forming apparatus, when, for example, a recording material is jammed, and is to be removed.

FIG. 1 shows a conventional structure for allowing the separation, wherein a sorter is provided with casters C and is supported on the floor, thus allowing the sorter to move on the floor (Japanese Laid-Open patent application No. 60-88969).

FIG. 2 shows another conventional structure, wherein a pair of guiding rails F (only one being shown) are mounted to a base E on which the image forming apparatus D is supported, and the sorter S is movable on the rails F (Japanese Laid-Open patent application No. 59-128161). In those Figures, reference numerals 1 and 11 depict discharging rollers; 2, 12, guides; 3, 13, inlet rollers; and 4, 14, bins.

In those structures, an operator has to push and move the relatively heavy sorters, and therefore, the jam disposal operation is cumbersome. Additionally, those structures adversely affect reception of the prints by the sorter from the image forming apparatus.

More particularly, since sheet handling machines such as a sorter, a collator and a finisher are considered as application-ware, they are constructed separately from the image forming apparatus, and they are attached to the image forming apparatus, as desired. Since those sheet handling apparatus handle sheets, they have to be aligned with respect to the image forming apparatus in a predetermined relationship. Particularly, the sheet conveying passages of the handling apparatus and of the image forming apparatus have to be correctly aligned, whereas the sheet handling apparatus has to be readily separated from the image forming apparatus so as to permit easy jam disposing operation. The sheet handling apparatus with casters supported on the floor, as shown in FIG. 1, involves a difficulty in correctly aligning the sheet passages between the image forming apparatus and the sheet handling apparatus. Additionally, when the floor is covered with a carpet or another fibrous material, the sheet handling apparatus is not easily moved by the casters sinking into the carpet, with the result that difficulty is encountered in attaching it to or separating it from the image forming apparatus.

SUMMARY OF THE INVENTION

Accordingly, it is a principal object of the present invention to provide an auxiliary machine supporting structure of better manipulation.

It is another object of the present invention to provide an auxiliary machine supporting structure by which the auxiliary machine is correctly aligned with an image forming apparatus used therewith.

It is a further object of the present invention to provide an auxiliary machine supporting structure by which the auxiliary machine is easily attached to or separated from the image forming apparatus.

It is another object of the present invention to provide an auxiliary machine supporting structure by which the auxiliary machine can be softly attached to the image forming apparatus.

It is a further object of the present invention to provide an auxiliary machine supporting structure by which the auxiliary machine can be softly stopped when it is separated from the image forming apparatus.

It is a further object of the present invention to provide an auxiliary machine supporting structure by which the auxiliary machine can be moved at different speeds for easy manipuration during separating or attaching movement thereof.

According to an embodiment of the present invention, the auxiliary machine is supported by a mechanism whereby the auxiliary machine can be easily moved for attachment and separation, and the alignment is assured.

According to another embodiment of the present invention, the supporting structure comprises a quadric crank chain structure with auxiliary links, which assures the easier manipulation and alignment.

According to an embodiment of the present invention, links for supporting and connecting the auxiliary machine are substantially vertical when the auxiliary machine is attached to the image forming apparatus, whereby the auxiliary machine can be more easily attached to the image forming apparatus.

According to an embodiment of the present invention, urging means is used to control movements of links for supporting and connecting the auxiliary machine to the image forming apparatus so that the auxiliary machine is softly and smoothly engaged to the image forming apparatus, whereas it can be separated from the image forming apparatus at an appropriate speed.

According to an embodiment of the present invention, a buffer or damper containing gas or liquid is used to control the speed of movement of the links for connecting and supporting the auxiliary machine to the image forming apparatus, so that the auxiliary machine can be softly and smoothly attached to the image forming apparatus, whereas the auxiliary machine can be separated from the image forming apparatus at an appropriate speed which continuously changes.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
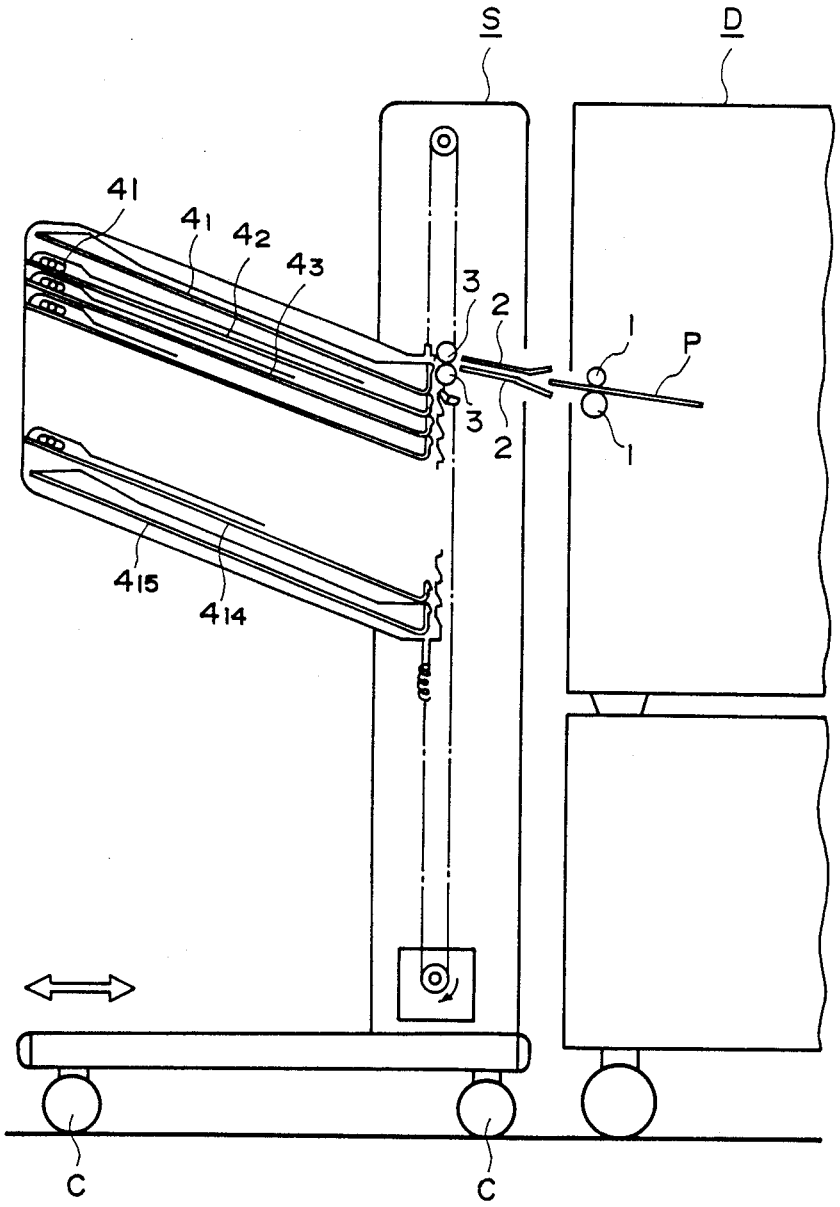
FIG. 1 is a front view of a sorter with an image forming apparatus, wherein the sorter is provided with casters.
Figure 2:
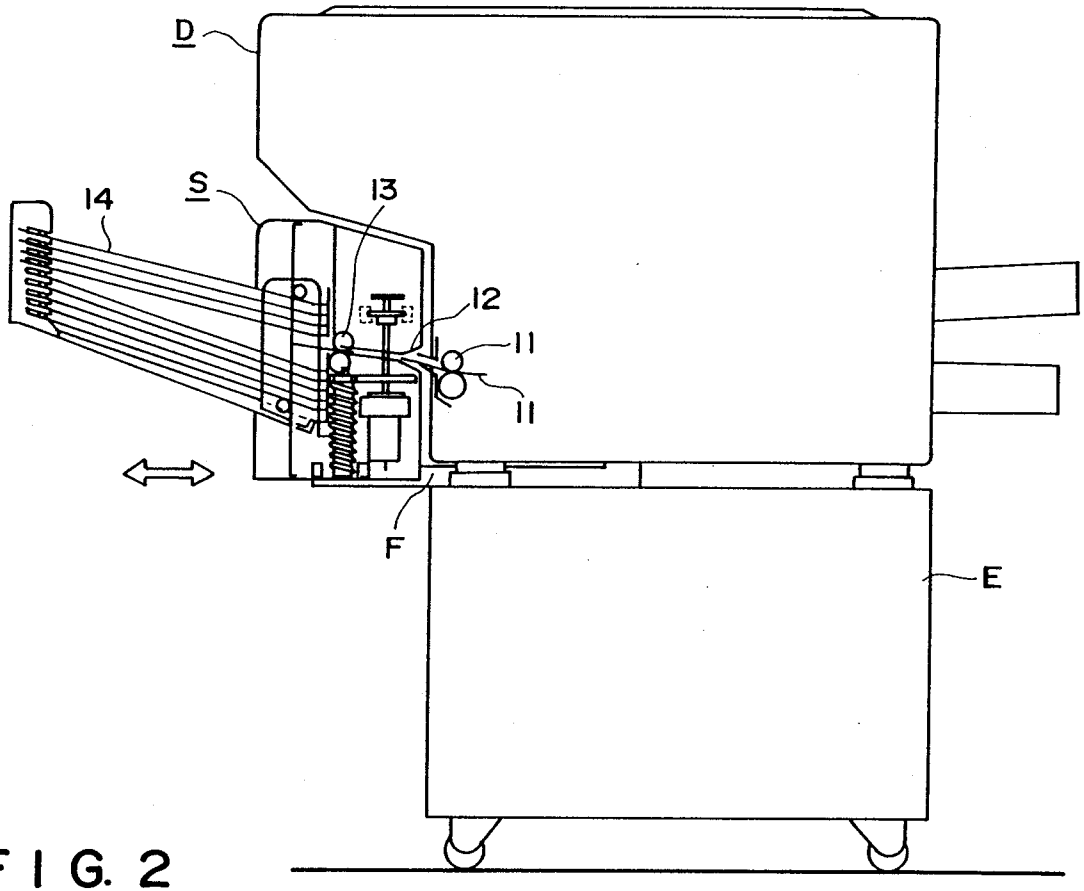
FIG. 2 is a front view of a sorter with an image forming apparatus wherein the sorter is supported on guide rails.
Figure 3:
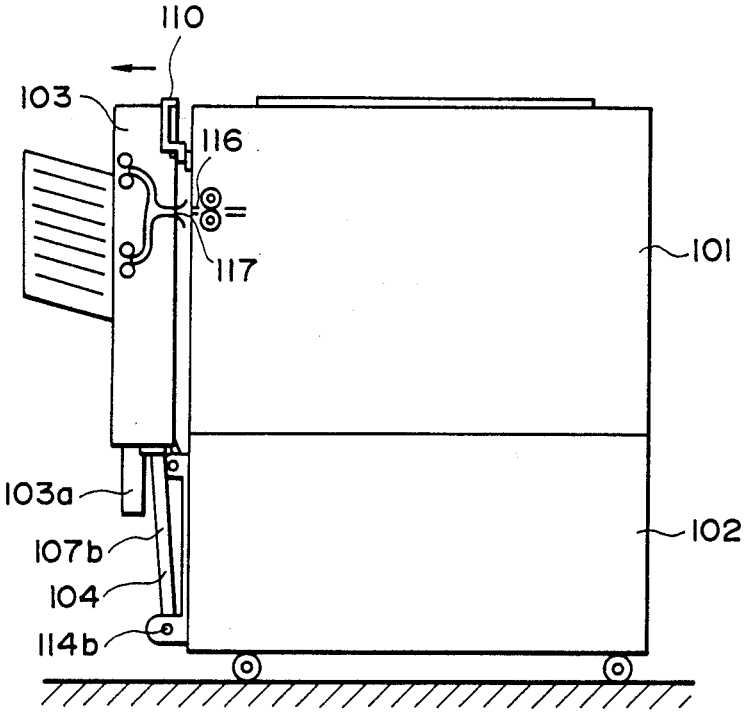
FIG. 3 is a front view of an image forming apparatus with a sorter mounted to the image forming apparatus by a supporting structure according to an embodiment of the present invention, wherein the sorter is attached to the image forming apparatus, that is, it takes its operative position.

Referring to FIG. 3, there is shown an image forming apparatus 101 equipped with a sorter 103 which is a movable bin type sorter in this embodiment. In the state shown, a sheet outlet of the image forming apparatus 101 is aligned with a sheet inlet 117 of the sorter 103. Since the structure of the sorting mechanism of the sorter 103 may be of conventional form, it is not being described in detail.

Figure 4:
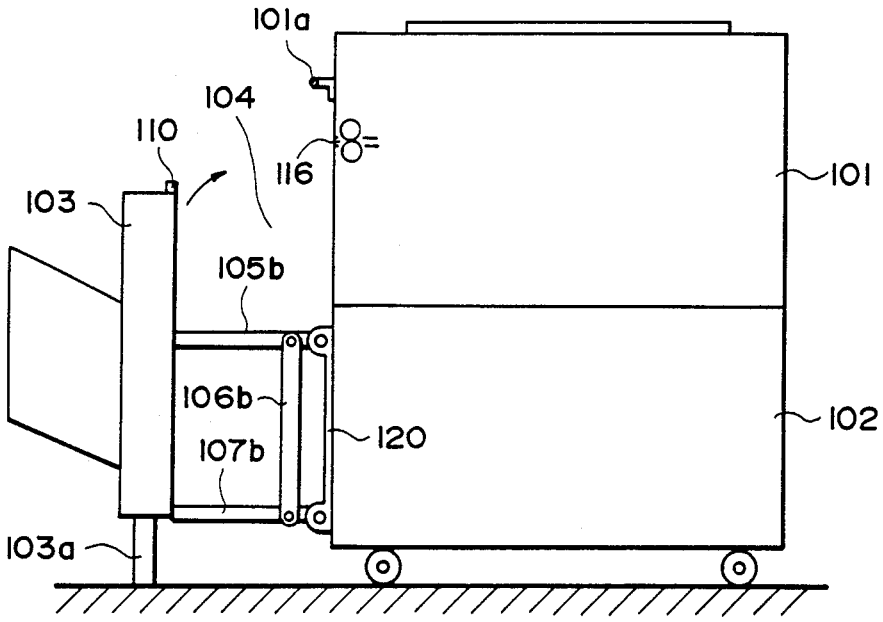
FIG. 4 is the same view, wherein, however, the sorter is separated from the image forming apparatus, that is, it takes its inoperative position.

When a sheet is jammed between the image forming apparatus 101 and the sorter 103, a grip 110 is moved in the direction indicated by an arrow to release the locking thereby, the sorter 103 slowly moves down until it takes a position shown in FIG. 4 to provide easy access to the outlet 116 and the inlet 117 by providing sufficient space 104 between the image forming apparatus 101 and the sorter 103.

The slow movement is provided by a spring having a proper spring constant in consideration of the weight of the sorter 103.

The structure of a link mechanism 104 will be described in detail, which is a quadric crank chain mechanism, in this embodiment.

Figure 8:
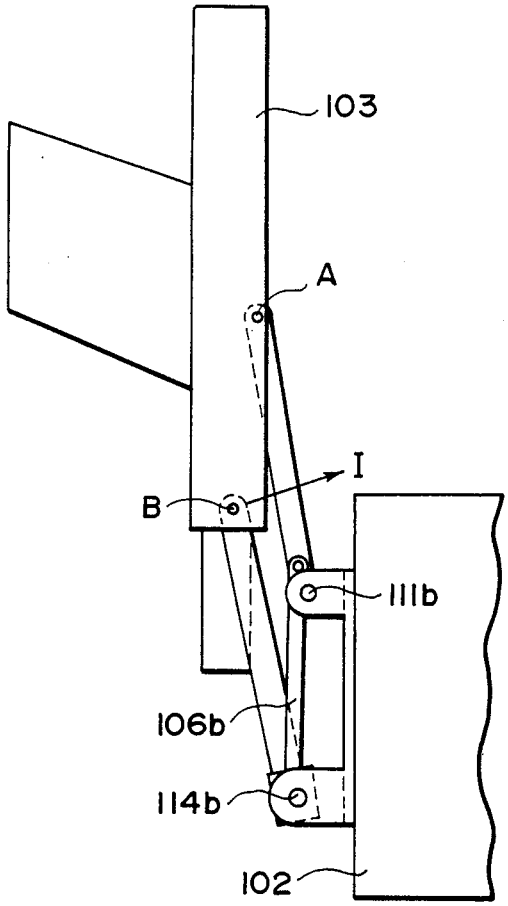
FIG. 8 is a front view of the supporting structure, wherein the auxiliary machine takes the operative position.

The link mechanism 104 comprises a couple of upper links 105*a* and 105*b*, a couple of lower links 107*a* and 107*b* and auxiliary links 106*a* and 106*b*. The auxiliary links 106*a* and 106*b* are effective to prevent the link mechanism from unintentionally collapsing by a pivot B moving to the image forming apparatus side beyond a pivot A as indicated by an arrow I in FIG. 8.

Figure 5:
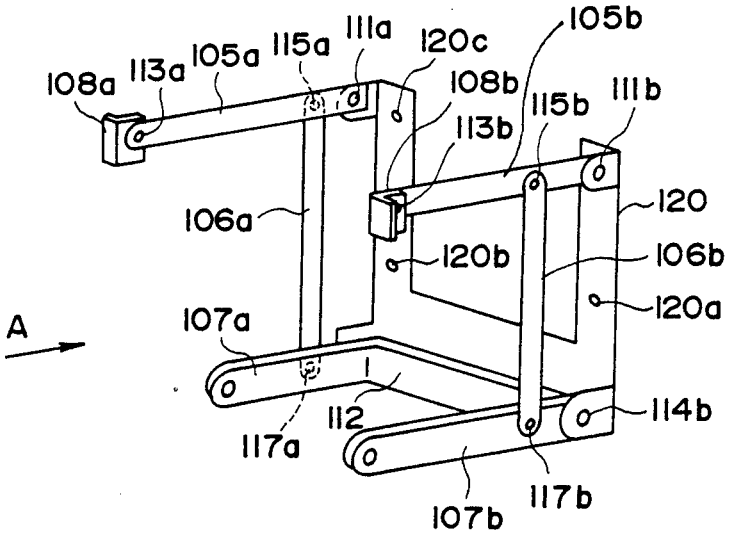
FIG. 5 is a perspective view of the supporting structure of the assembly shown in FIG. 3.
Figure 6:
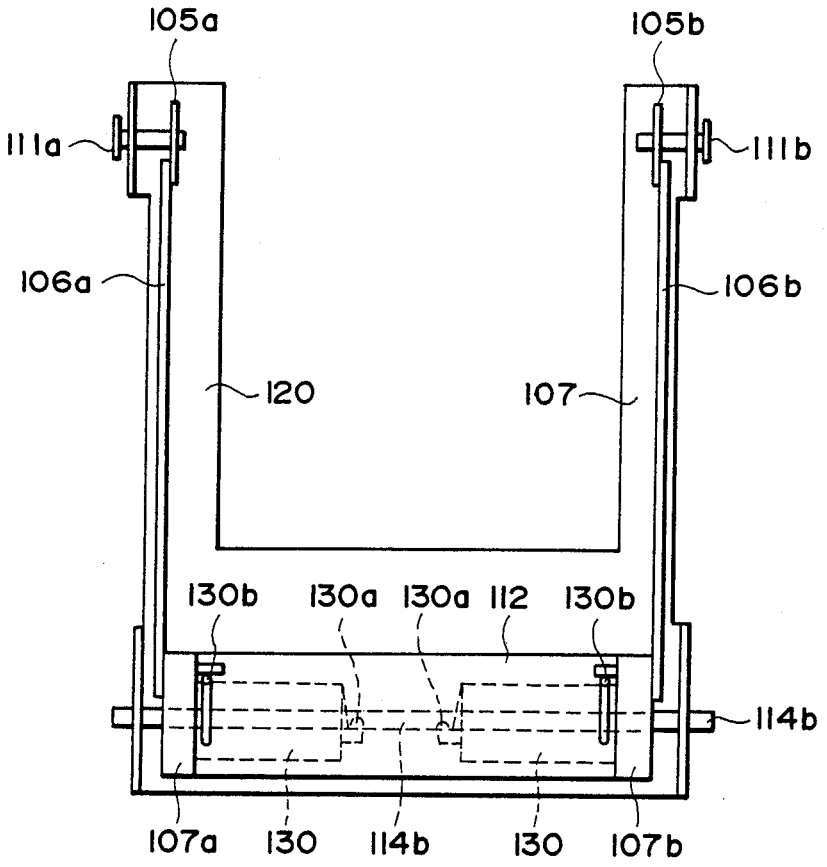
FIG. 6 is a side view of the supporting structure.
Figure 7:
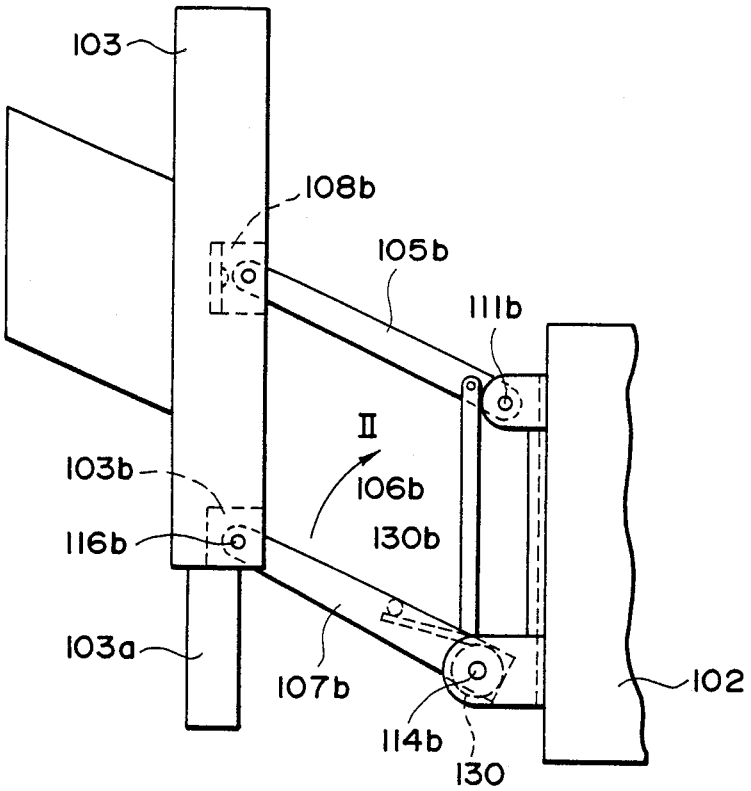
FIG. 7 is a front view of the supporting structure, wherein the auxiliary machine is in an intermediate position.

As best seen in FIG. 5 which is a perspective view and FIG. 6 which is a side view as seen in the direction shown by an arrow A in FIG. 5, the upper links 105*a* and 105*b* are pivotably supported by pins 111*a* and 111*b*, respectively to a link supporting plate 120. The lower links 107*a* and 107*b* are connected to each other by a box 112 (FIG. 6), and are pivotably mounted to the link supporting plate 120. In the box 112, there are two torsion or coil springs 130 which serve as buffering or damper means. The torsion spring normally urges the links 107*a* and 107*b* in the direction indicated by II, as shown in FIG. 7. Therefore, the links 107*a* and 107*b* are normally urged for rotation in that direction, and therefore, the sorter 103 is normally urged toward the image forming apparatus. Each of the coil springs 130 is wound around a shaft 114*b* and has an end 130*b* engaged with the link 107*a* (107*b*) and the other end 130*a* engaged to the shaft 114*b*. The shaft 114*b* is securedly fixed to the supporting plate 120, while the links 107*a* and 107*b* are rotatable around the shaft 114*b*.

The auxiliary links 107*a* and 106*b* connect the upper link 105*a* and the lower link 107*a*, and the upper link 105*b* and the lower link 107*b*, respectively, to provide equivalent movements of the upper and lower links 105*a*, 105*b*, 107*a* and 107*b*. When the sorter 103 is being lowered, the auxiliary links 106*a* and 106*b* are compressed, whereby the lower links 107*a* and 107*b* are pushed down by the auxiliary links 106*a* and 106*b* which are pushed down by the associated upper links 105*a* and 105*b*. When, on the contrary, the sorter 103 is being lifted, the upper links 107*a* and 107*b* are pushed upwardly by the auxiliary links 106*a* and 106*b* which are pushed up by the lower links 107*a* and 107*b*. Therefore, the link mechanism is prevented from unintentional collapse at a pivot B or a pivot A, because matched movements are assured between upper links 105*a* and 105*b* and the lower links 107*a* and 107*b* so that the sorter 103 is prevented from tilting. In addition, the auxiliary links 106*a* and 106*b* are effective to prevent the upper and lower links from bending. In this manner, the movement of the link mechanism is made smooth. The auxiliary links 106*a* and 106*b* are pivotably supported to the associated links 105*a*, 105*b*, 107*a* and 107*b* by pins 115*a*, 115*b*, 117*a* and 117*b*, respectively. The auxiliary links 106*a* and 106*b* extend substantially parallel to a line connecting the pivots A and B and connect one of the upper links and the associated lower link, and the other upper link and the other lower link.

The auxiliary links 106*a* and 106*b* may be disposed closer to the image forming apparatus beyond the supporting pins 111*a*, 111*b*, 114*a* and 114*b*, more particularly to the right side of those pins (FIG. 7). In this case, when the sorter 103 is being moved down, the auxiliary links lift the lower links up, whereas when the sorter 103 is being lifted, the auxiliary links lower the lower links.

The upper links 105*a* and 105*b* are fixed to a middle portion of the sorter 103 by screws or the like using connecting plates 108*a* and 108*b* pivotably mounted to the upper links 105*a* and 105*b* by pins 113*a* and 113*b*. The lower links 107*a* and 107*b* are pivotably connected by a supporting shaft 116*b* to a connecting plate 103*b* mounted to the bottom of the sorter 103.

The link supporting plate 120 is securedly fixed to a discharge side frame 102 of the image forming apparatus 101 by screws through holes 120*a*, 120*b*, 120*c*.

FIG. 4 shows a state wherein the sorter 103 takes the lowermost position, that is, a leg or legs 103*a* bear on the floor.

When the sorter 103 is to be lifted to the operative position, an operator grips the sorter grip 110 and lifts it. Then, the sorter 103 moves up by the forces exerted by the operator and exerted by the spring 130. A locking portion of the grip 110 is engaged with a latch provided in the image forming apparatus 101 (FIG. 3). The operator's force is not so large, because the spring force is codirectional.

The link mechanism of this embodiment may be modified within the scope of the present invention, and therefore, the present invention is not limited to this embodiment. For example, the present invention is applicable to a separating mechanism for a sheet discharging portion of the image forming apparatus itself. As an another example, the sorter described above may be replaced by another peripheral device (paper handling device). In those cases, the jam disposal operation is made easier.

The torsion or coil spring may be replaced by an air damper to compensate the weight of the sorter.

The spring constant of the spring may be so determined that the spring force is equivalent to the weight of the sorter 103. More particularly, the spring constant is made smaller so that the sorter is supported as if it is suspended by a tension spring stretched between an end of the sorter and the image forming apparatus. Then, when the sorter is released from the lock, the sorter floats away from the image forming apparatus, and therefore, the sorter may be lowered by lightly pushing it downwardly. On the other hand, by lightly and continuously pushing the sorter upwardly, the sorter gradually rises. By detaching the operator's hand from the sorter during lowering or lifting movement of the sorter, the sorter then stops there as if it is floating.

Figure 9:
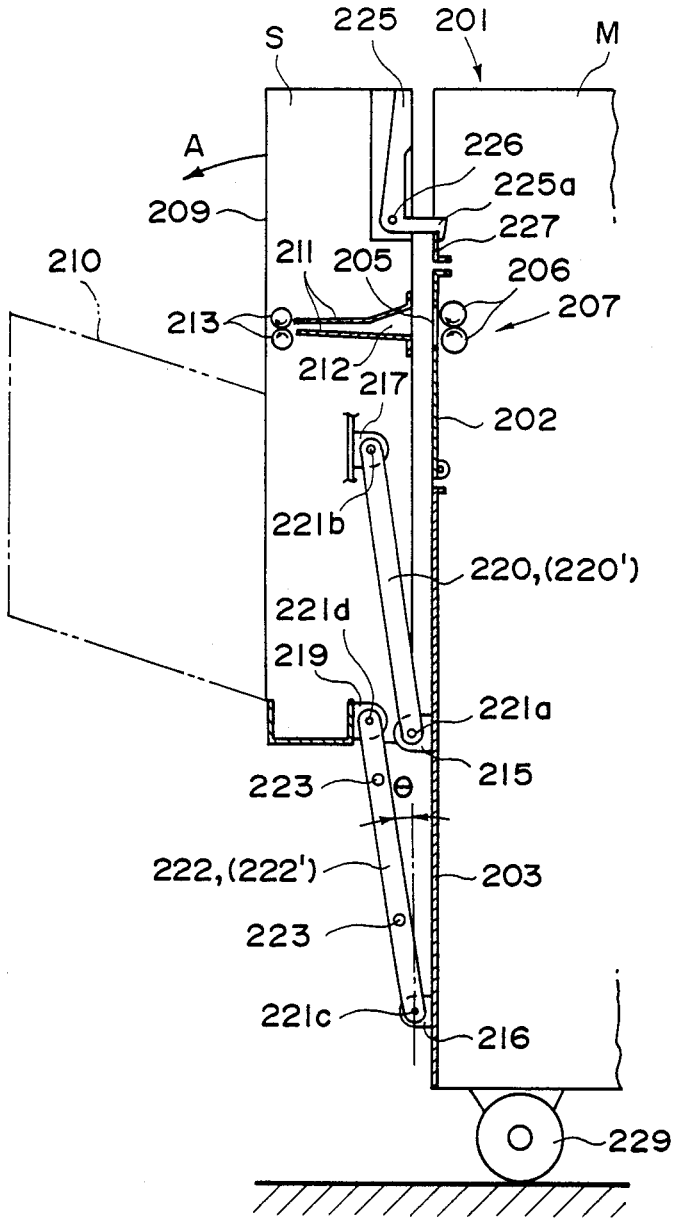
FIG. 9 is a front view of an auxiliary machine with a supporting structure therefor, according to an embodiment of the present invention.

FIG. 9 illustrates another embodiment of the present invention.

In FIG. 9, a sorter S having a function of automatically sorting prints discharged from the image forming apparatus which is a copying apparatus M in this embodiment, is attached to the copying apparatus M so as to receive the prints from a sheet discharging portion 201 of the copying machine M.

The sheet discharging portion 201 of the copying apparatus M has an upper side plate 202 and a lower side plate 203. The upper side plate 202 is provided with a sheet discharging opening 205, in alignment with which a couple of discharging rollers 206 is provided. The sheet discharging opening 205 and the discharging roller couple 206 cooperate to constitute sheet outlet 207. The sorter S contains a number of bins 210 at one side of the main body 209 thereof. Within the main body 209, there is a couple of sheet guides 211 which constitute a sheet conveying passage 212. Downstream of the sheet conveying passage 212, there is a couple of conveying rollers 213 which functions to discharge the sheet introduced into the conveying passage 212 to the bin 210.

To the lower side plate 203 of the copying machine M, upper and lower supporting members 215 and 216 are securely fixed. To a side of the main body 209 of the sorter S, upper and lower supporting members 217 and 219 are securely fixed. An upper link 220 extends between the upper supporting member 215 of the copying apparatus M and the upper supporting member 217 of the sorter S. An end of the upper link 220 is pivotably mounted by a pin 221*a* to the upper supporting member 215, while the opposite end thereof is pivotably supported to the upper supporting member 217 of the sorter S by a pin 221*b*. A lower link 222 is extended between the lower supporting member 216 of the copying apparatus M and the lower supporting member 219 of the sorter S. An end of the lower link 222 is pivotably mounted to the lower supporting member 216 of the copying apparatus M by a pin 221*c*. The opposite end of the lower link 222 is pivotably mounted to the lower supporting member 219 of the sorter S by a pin 221*d*. The upper and lower links 220 and 222 are substantially parallel to each other. The distance between the pins 221*a* and 221*b*, which constitute first and second pivots, respectively, is substantially the same as the distance between the pins 221*c* and 221*d* constituting third and fourth pivots. Thus, a parallel or substantially parallel link mechanism is constituted wherein the upper and lower links are moved about the first, second, third and fourth pivots, namely, pins 221*a*, 221*b*, 221*c* and 221*d*, while the sorter S is translated. Further, the pins 221*b* and 221*d* constituting the second and the fourth pivots are so positioned that, when the sorter S is engaged with the copying apparatus M, the pins 221*b* and 221*d* are above the pins 221*a* and 221*c* constituting the first and third pivots, respectively, and that the upper and lower links 220 and 222 are inclined with respect to a vertical line within a predetermined angle $\theta$ (0–30 degrees), whereby substantially no rotational moment, or a very small moment if any, is applied by the weight of the sorter S to the upper and lower links 220 and 222, when the sorter S is engaged to the copying apparatus M. If, however, the angle $\theta$ is 0, the engaged position constitutes a dead position so that when the sorter S is lowered by pushing the top surface thereof down, no rotational force is produced to the upper and lower links resulting in difficulty in lowering the sorter S. Therefore, to avoid the constitution of the dead position, the angle is preferably several degrees.

The foregoing description has been made with respect only to the links and pins of the front side of the apparatus (FIG. 9). However, there are provided symmetrical links 220' and 222' which constitute couples with the links 220 and 222, respectively. The lower links 222 and 222' are connected integral by auxiliary stays 223 and 223 extending perpendicular to the sheet of the drawing (FIG. 9) to prevent a portion of the links 222 from twisting and 222'.

At an upper portion of the sorter S, a locking lever 225 is pivotably supported by a lock lever pin 226. Correspondingly, the copying apparatus M is provided with a latch 227 on the upper side plate 202 thereof.

The copying machine M is provided at the bottom thereof with casters 229 to provide free movement of the copying apparatus M on the floor.

As described in the foregoing, the sorter connecting mechanism of this embodiment is constituted by front side upper and lower links 220 and 222, rear side upper and lower links 220' and 222' and the locking lever 225 and others, and therefore, the sorter S supported by the links 220, 222, 220' and 222', when it is engaged with the copying apparatus M, the sheet conveying passage 212 is correctly aligned with respect to the sheet discharging passage of the copying apparatus M with the alignment maintained by the locking lever 227 engaged with the latch. When the sorter S is engaged with the copying apparatus, a rotational moment is hardly exerted on the links 220, 222, 220' and 222' by the weight of the sorter S. For this reason, the weight of the sorter S is not applied to the portion where the locking lever 225 and the latch 227 are engaged.

In operation of the copying apparatus, a printed or copied sheet is discharged by the discharging roller couple 226 through the discharge opening 205, and it is introduced into the sheet conveying passage 212 of the sorter S. The sheet is discharged to an appropriate bin 210 by the conveying roller couple 213.

When the sheet is jammed, an operator depresses the locking lever 225 to disengage the hook 225*a* from the latch 227 to make disposal of the jammed paper possible. At this time, since the rotational movement exerted by the weight of the sorter S to the links 220, 222, 220' and 222' is very small, it does not occur that the sorter S suddenly separates from the copying apparatus M. So, the operator pushes the sorter S in the direction indicated by an arrow A to separate it from the copying apparatus M, by which the links 220, 222, 220' and 222' smoothly rotate counterclockwise. By slight counterclockwise rotation of the links 220, 222, 220' and 222', the rotational moment by the weight of the sorter S becomes applied to those links so that the sorter S lowers without force applied by the operator to be separated from the copying apparatus M. By the separation, space is formed between the copying apparatus M and the sorter S enable the operator to access to the outlet side of the copying apparatus M and the inlet side of the sorter S. Then, the operator disposes of the jammed sheet, and thereafter, the sorter S is engaged back with the copying apparatus M. During the restoring operation, the links 220, 222, 220' and 222' are smoothly rotated to their upright positions with the decreasing rotational moment by the sorter S, until the sorter S is engaged with the copying apparatus M, again. When the sorter S is moved to the topmost position, and it is locked by the locking lever 225, the rotational moment to the links is substantially zero, or very small if any. Thus, the sorter S is engaged with the copying apparatus M without independent contact thereof to the floor. Therefore, when the copying apparatus M is moved on the floor with the aid of the casters 229, the relative positional relation between the sheet passages thereof are not misaligned, while the sorter is separable from the copying apparatus M.

Figure 10:
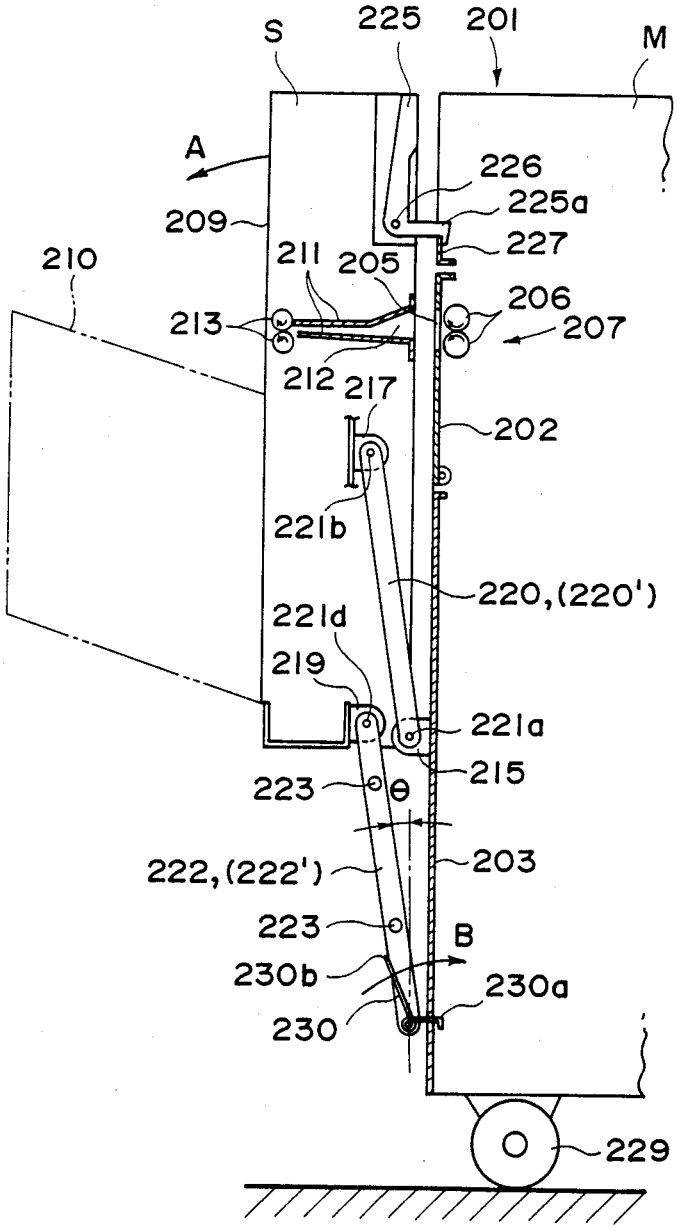
FIG. 10 is a front view of an auxiliary machine with a supporting structure therefor having a torsion spring, according to an embodiment of the present invention.

In order to prevent the sorter from rapidly lowering when it is separated from the copying apparatus M, a torsion or coil spring may be used as shown in FIG. 10, wherein the torsion spring 230 is wound around the pin 221*c* constituting the third pivot. An end 230*a* of the torsion spring 230 is fixed to the lower supporting member 216 of the copying apparatus M, while the other end 230*b* is engaged with the lower link 222 so as to urge the lower link 222 in the direction indicated by an arrow B. By doing so, the torsion spring 230 is effective to prevent the sorter S from abruptly falling away from the copying apparatus, and it is lowered at an appropriate speed, while it can be lifted by a smaller force when the sorter S is engaged back with the copying apparatus M.

More particularly, the torsion spring 230 about the third pivot (pin 221*c*) has various dimensions and resiliency which are appropriately determined in accordance with the weight of the sorter S and the lengths of the links and others. When the sorter S is engaged with the copying apparatus M, the end 230*b* of the spring 230 is simply contacted to the lower link 222 without strongly pressing the lower link 222 in the clockwise direction, but when the sorter S is lowered or separated from the copying machine M to rotate the lower link 222 away from the copying apparatus M, the end 230*b* of the spring 230 applies the spring force to the lower link 222 in the clockwise direction, by which the sorter does not fall abruptly.

The connecting mechanism of this embodiment (FIG. 10) is constituted by the front links 220 and 222 and rear links 220' and 222' and torsion spring 230, arranged in the manner described in the foregoing, and therefore, the sorter S is not quickly separated from the copying apparatus M. When the sorter S is further separated from the copying apparatus M by pushing it in the direction of the arrow A, the links 220, 222, 220' and 222' supporting the sorter S smoothly rotate, and together with the rotation, the rotational moment applied to those links by the weight of the sorter S gradually increases, with the result that the sorter S tends to quickly lower and separate from the copying apparatus M. However, the torsion spring 230 having the various dimensions and resiliency determined to match with the weight of the sorter S functions as a buffer to allow the sorter S to lower only at an appropriate speed. During this, the operator may be just touching the sorter S. Then, the operator removes a jammed sheet from the sorter S. Thereafter, the sorter S is again engaged with the copying apparatus M. During this restoring operation, the torsion spring 230, which urges the lower link 222 in the direction indicated by an arrow B, reduces the force required to raise the sorter S, by which smooth movement is made possible. With the raising, the rotational moment due to the weight of the sorter S applied to the links decreases. When the sorter S is engaged to the copying machine and is locked by the locking lever 225, the rotational moment is substantially zero, or very small if any.

In the description of this embodiment, the lock lever 227 is employed to maintain the sorter S to be engaged with the copying apparatus M, but the lock lever 227 is not necessary, if the torsion spring 230 is set such that it urges the sorter S to the copying apparatus M by its spring force.

More particularly, in the embodiment described, the torsion spring 230 does not act on the lower link 222 when the sorter S is engaged with the copying apparatus M, but the setting of the spring 230 may be changed such that the spring force is applied in the direction of the arrow B to securely bear the sorter S onto the copying apparatus M.

Figure 11:
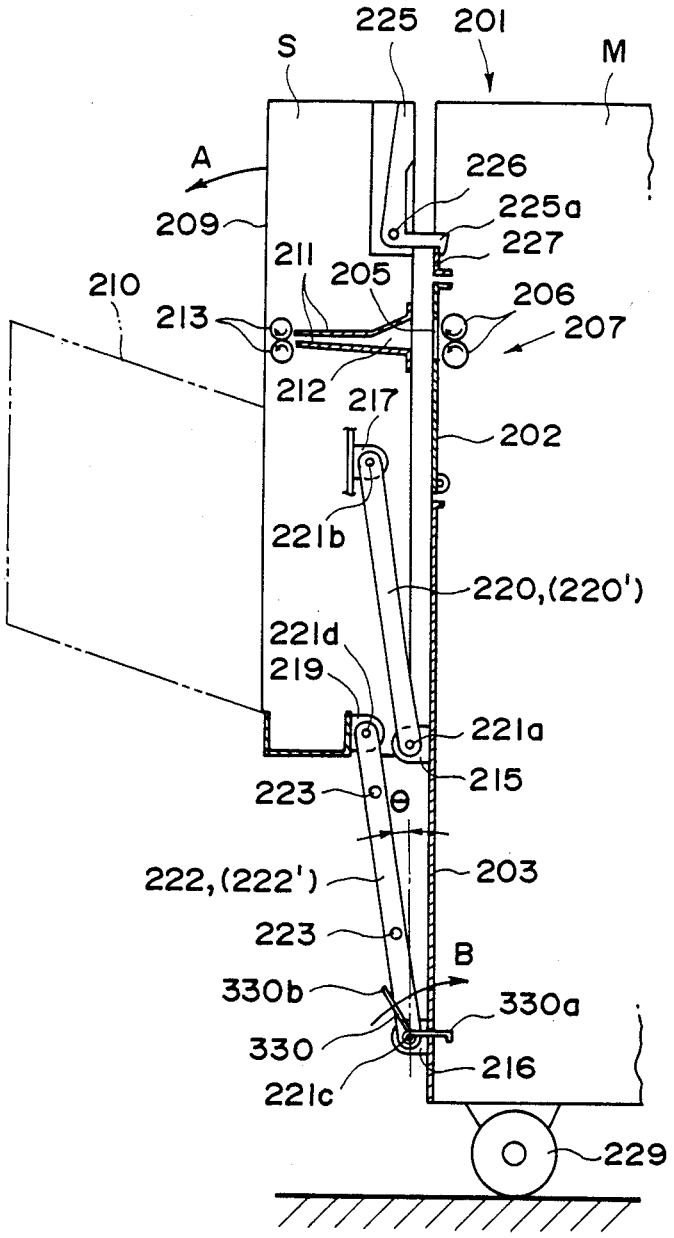
FIG. 11 is a front view of a sorter with a supporting structure therefor which is similar to the structure of FIG. 10 but with a modification in which there is play for the torsion spring.

FIG. 11 illustrates a modification of FIG. 10 embodiment, wherein an acting end 330*b* of the torsion spring 330 is slightly spaced from the lower link 220, when the sorter S is engaged with the copying apparatus M. That is, a play is formed between the torsion spring 330 and the lower link 222. In the modified structure, the spring force does not act on the lower link 222 at the initial stage of the separating operation, so that the initial separation of the sorter S from the copying apparatus M is smoother.

Figure 12:
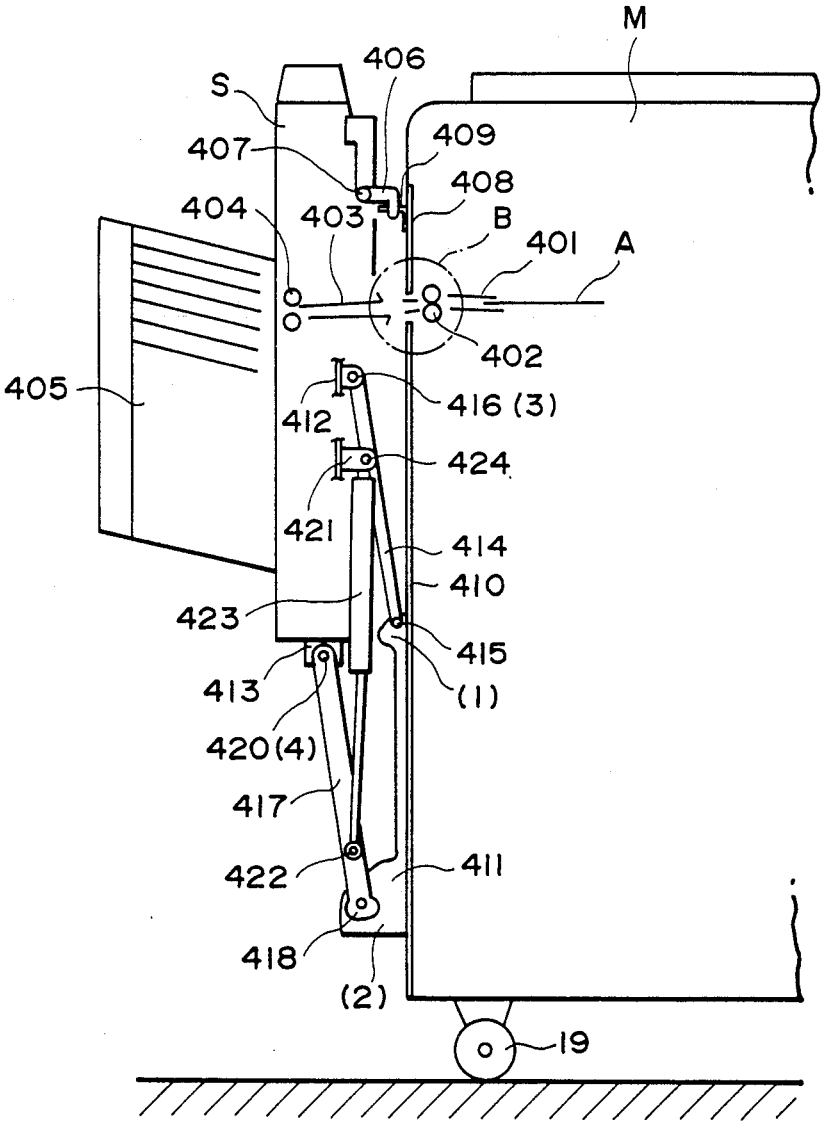
FIG. 12 is a front view of an auxiliary machine with a supporting structure therefor, according to a further embodiment of the present invention.

FIG. 12 illustrates a further embodiment of the present invention, wherein a sheet handling device (a sorter for automatically sorting sheets discharged from a copying apparatus) is connected with the copying apparatus M by a connecting structure according to this embodiment of the present invention. A transfer sheet A on which an image is formed by the copying apparatus M is discharged by discharging rollers 402 along the sheet guide 401 to the sheet guide 403 of the sorter S and is received by one of bins of the sorter S by sorter discharging rollers 404.

In an upper portion of the sorter S, there is provided a hook handle 406 which is engageable with a latch 409 fixed to the upper side plate 408 of the copying apparatus M. The copying apparatus M has a lower side plate 410 to which a base plate 411 of the connecting structure is fixed. The connecting structure base plate 411 has a pivot in an upper portion and a pivot in the lower portion. To a front plate of the sorter S, an upper supporting member 412 and a lower supporting member 413 are fixed at the upper pivot of the base plate 411, and an upper link 414 is rotatably mounted by a pin 415. The upper link 414 is pivotably connected by a pin 416 to the upper supporting plate 412 of the sorter S. At the lower pivot of the base plate 411, a lower link 417 is rotatably mounted by a pin 418. The lower link 417 is pivotably mounted by a pin 420 to the lower supporting member 413 of the sorter S. Those pivots and the upper and lower links 414 and 417 pivotable about those pivots constitute a parallel crank mechanism or a substantially parallel crank mechanism. A buffer or damper 424 using a gas or gases and designed appropriately in accordance with the weight of the sorter S and a rotational moment to the upper and lower links is stretched between a pin 422 of the lower link 417 and a pin 424 of an intermediate supporting member 421 of the sorter S.

Figure 13:
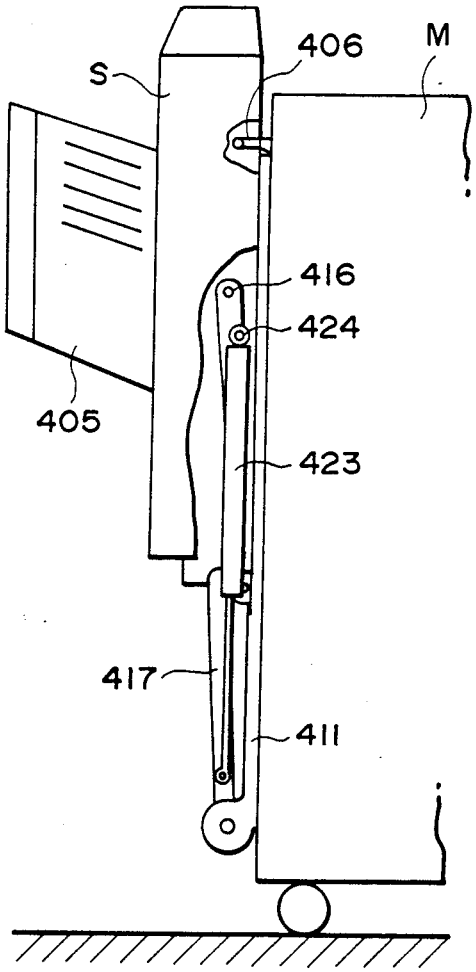
FIG. 13 is the same view, wherein, however, the auxiliary machine is attached to the image forming apparatus.

FIG. 13 shows a state wherein the sorter S is engaged with the copying apparatus M to be operable for receiving and sorting the sheets received from the copying apparatus M.

The buffer 423 has a piston rod 423*a*, which is most or substantially most extended in this state, where force applied to the pin 424 of the supporting member 421 of the sorter S and to the pin 422 is zero or substantially zero, while the sorter S is maintained to be engaged with the copying apparatus M.

Figure 14:
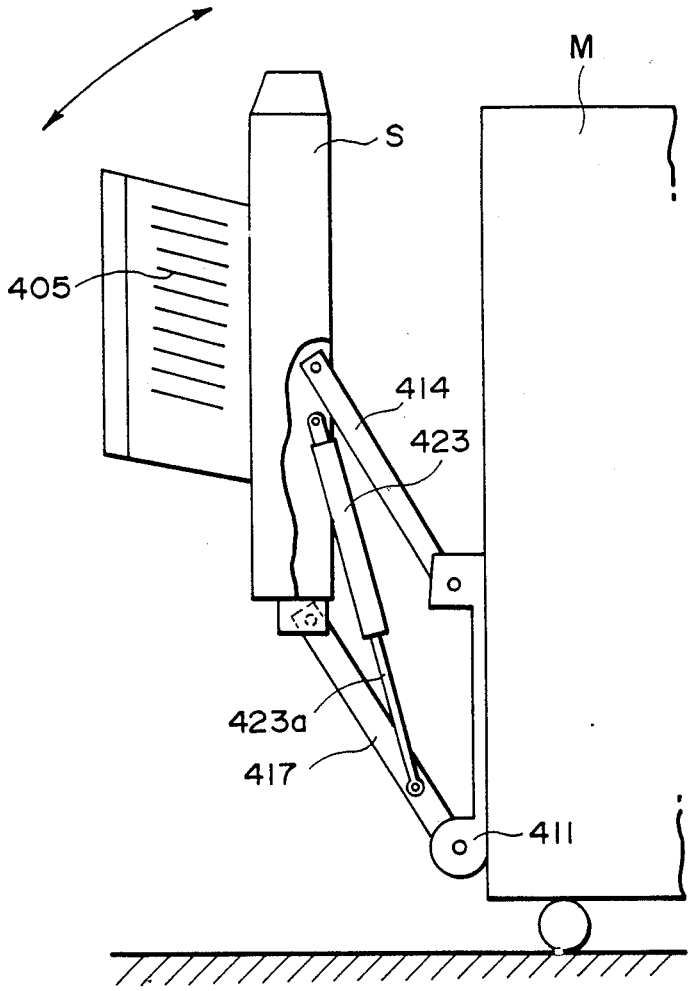
FIG. 14 is the same view, wherein, however, the auxiliary machine is in the intermediate position.
Figure 15:
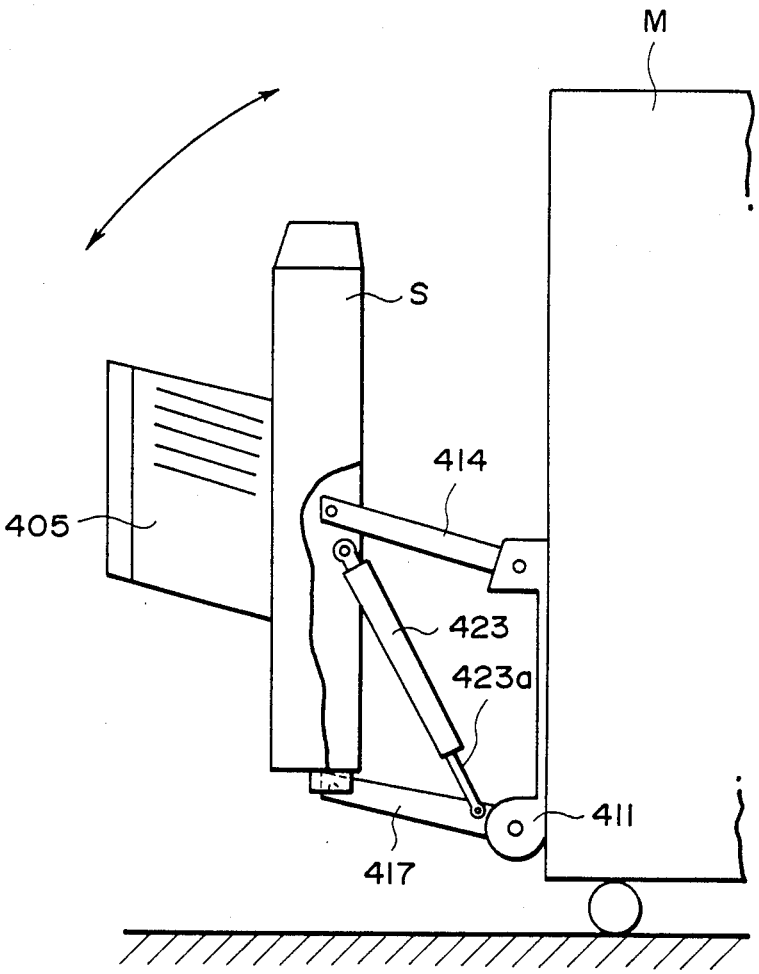
FIG. 15 is the same view, wherein, however, the auxiliary machine is separated from the image forming apparatus.
Figure 16:
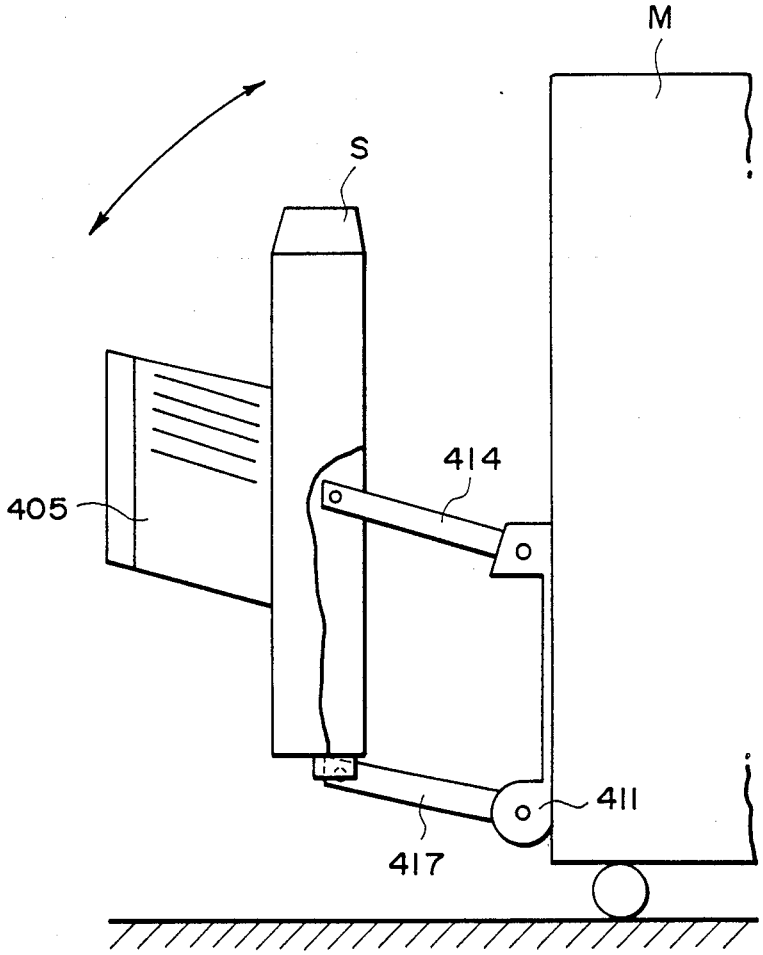
FIG. 16 is a front view of the auxiliary machine with a supporting structure therefor having links only.
Figure 17:
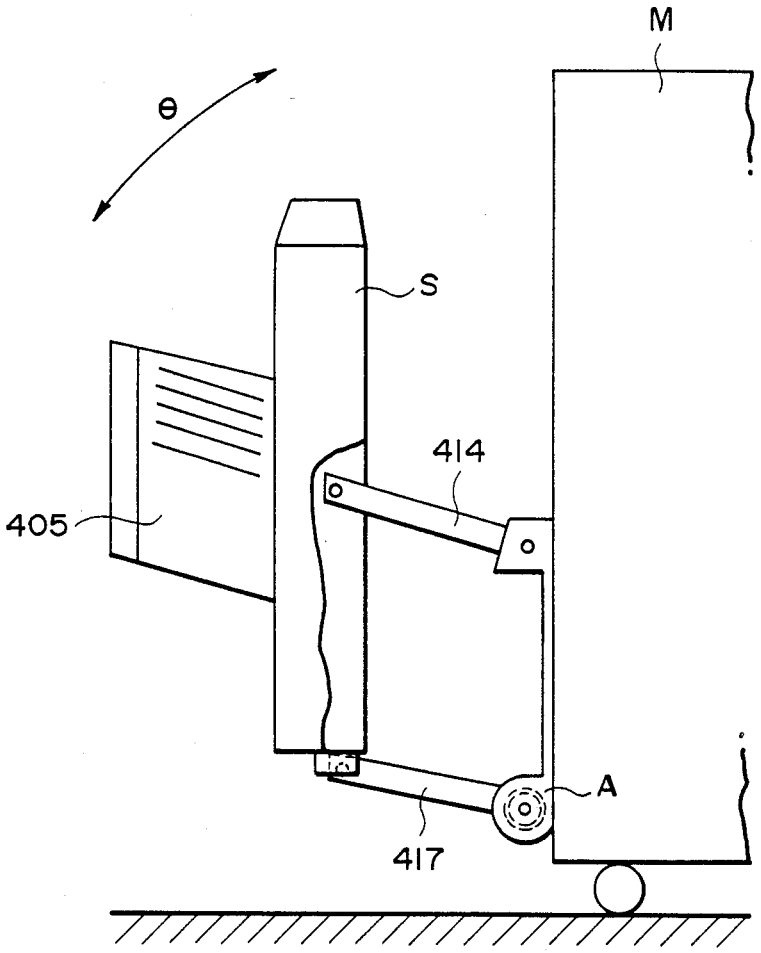
FIG. 17 is a front view of the auxiliary machine with a supporting structure therefor having links and a torsion spring.

When the sorter S is separated from the copying apparatus M to remove a jammed sheet which has been jammed in the region indicated by B in FIG. 12, the sorter S is separated from the copying apparatus M as shown in FIGS. 14 and 15. During such movement, the buffer 423 using a gas or gases or liquid prevents abrupt rotation of the upper and lower links 414 and 417 supporting the sorter S about the pivots. One skilled in the art can determine various dimensions and parameters of the buffer 423 to provide this function. When the sorter S is restored to be engaged with the copying apparatus M, the buffer 423 provides appropriate friction property to allow smooth continuous movement of the sorter S to the copying apparatus M.

The present invention is not limited to this embodiment. For example, the sorter may be replaced by a finisher, a collator or a deck or other auxiliary machines usable with the image forming apparatus which is a copying machine in this embodiment. Besides those peripheral devices, the supporting structure of this embodiment or invention may be applicable to a structure for allowing easier jam disposal in an image forming apparatus, for example, in a sheet discharging or supplying station. The employment of the buffer provides a latitude matching various operating conditions.

Figure 18:
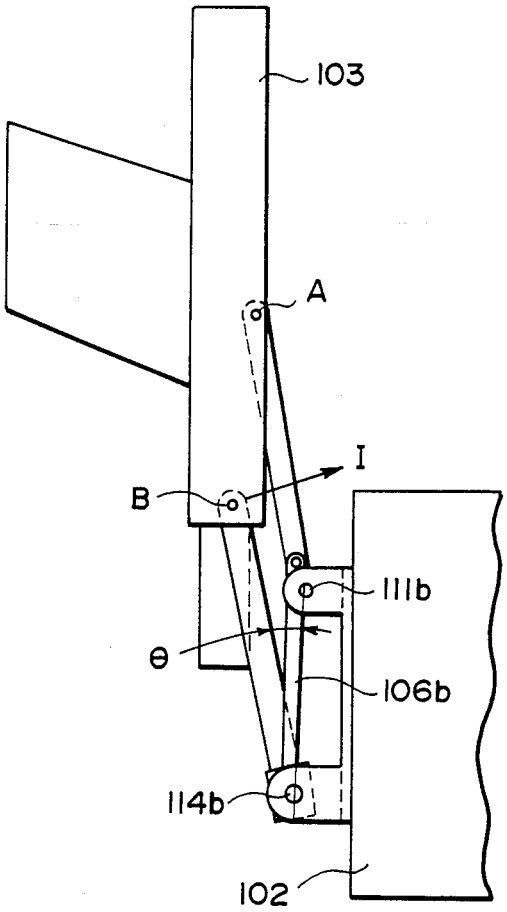
FIG. 18 is a front view of an auxiliary machine with a supporting structure therefor, which is a modification of the structure shown in FIG. 8.

FIG. 18 shows a modification of the first embodiment. In the modification, the angle $\theta$ similar to that of the second embodiment (FIG. 9) is formed.

Figure 19:
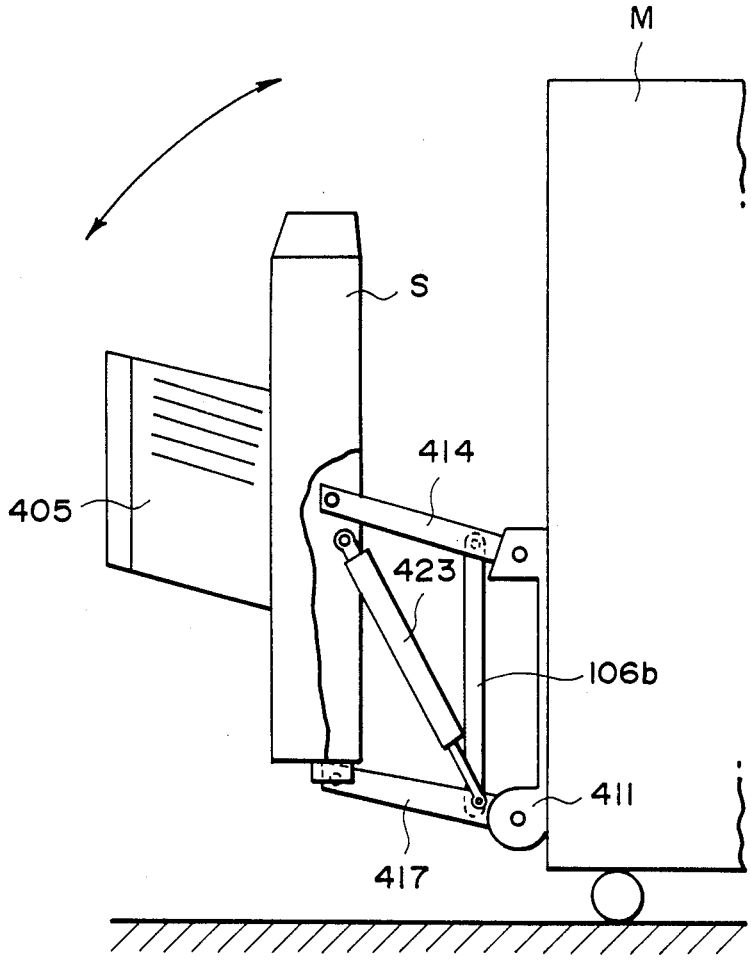
FIG. 19 is a front view of an auxiliary machine with a supporting structure therefor, which is a modification of the structure shown in FIG. 15.

FIG. 19 shows a modification of the third embodiment. In the modification, an auxiliary link 106*b* as in the first embodiment (FIG. 4) is employed. In this modification, the angle $\theta$ of the second embodiment may be formed.

Since the other structures in the devices of FIGS. 18 and 19 are similar to the embodiments from which they are modified, detailed explanation is omitted for the sake of simplicity.

While the invention has been described with reference to the structures disclosed herein, it is not confined to the details set forth and this application is intended to cover such modifications or changes as may come within the purposes of the improvements or the scope of the following claims.

For example, the auxiliary device may be driven by a motor or other driving means to raise or lower the auxiliary apparatus. The motor may be operatively connected to one or more of the lower links 107*a* or 107*b*, for example. It is possible to provide the motor either on the side of the image forming apparatus or on the side of the auxiliary apparatus. The latter will be convenient in the case where the auxiliary apparatus is optionally used by users since the motor is not contained in the main apparatus. However, from the standpoint of reducing the weight of the entire assembly of the auxiliary apparatus, the motor is preferably mounted in the image forming apparatus. Actuation of the motor may be interrelated with the engaging means 110, for example. For stopping the motor, a limit switch or limit switches may be appropriately arranged.

What is claimed is:

1. A device for separably supporting an auxiliary means to an image forming apparatus, comprising:

supporting means for supporting the auxiliary means and for allowing the auxiliary means to move up and down between an operative position wherein the auxiliary means is cooperable with the image forming apparatus and a retracted position wherein said auxiliary means is retracted from the operative position; and means for retaining the auxiliary means at the operative position.

2. A device according to claim 1, further comprising balance means for reducing force required to move the auxiliary means.

3. A device according to claim 2, wherein said balance means includes a spring.

4. A device according to claim 2, wherein said balance means includes a fluid damper means.

5. A device according to claim 1, wherein said retaining means includes means for locking the auxiliary means at the operative position.

6. A device according to claim 1, wherein said supporting means includes a rotatable member to move the auxiliary means away from the image forming apparatus when it moves down.

7. A device for separably supporting an auxiliary means to an image forming apparatus, comprising:

quadric link means for supporting the auxiliary means and for allowing the auxiliary means to move up and down between an operative position wherein the auxiliary means is cooperable with the image forming apparatus and a retracted position wherein said auxiliary means is retracted from the operative position; and means for retaining the auxiliary means at the operative position.

8. A device according to claim 7, wherein one end of said link means is rotatably supported to the image forming apparatus, and the other end thereof is rotatably supported to the auxiliary means.

9. A device according to claim 8, wherein said link means includes a couple of parallel links, whereby the auxiliary means translate away from the image forming apparatus when it moves down.

10. A device according to claim 9, wherein said link means includes an auxiliary link connecting the parallel links.

11. A device according to claim 7, wherein said link means includes a link which extends substantially vertically when the auxiliary means is at the operative position.

12. A device according to claim 7, wherein said link means includes a link which is slightly inclined from a vertical line away from the image forming apparatus.

13. A device according to claim 7, wherein said retaining means includes means for locking the auxiliary means at the operative position.

14. A device according to claim 7, further comprising balance means for reducing force required to move the auxiliary means.

15. A device according to claim 14, wherein said balance means includes a spring.

16. A device according to claim 14, wherein said balance means includes a fluid damper means.

17. A device according to claim 7, wherein the auxiliary means is a sorter.

18. A device for separably supporting an assembly to an image forming apparatus, comprising:

supporting means for supporting the assembly and for allowing the assembly to move up and down between an operative position wherein the assembly is cooperable with the image forming apparatus and a retracted position wherein said assembly is retracted from the operative position; and means for retaining the assembly at the operative position.

* * * * *

UNITED STATES PATENT AND TRADEMARK OFFICE

CERTIFICATE OF CORRECTION

PATENT NO. : 4,734,748

DATED : March 29, 1988

INVENTOR(S) : TOSHIAKI MURAYAMA, ET AL.

It is certified that error appears in the above-identified patent and that said Letters Patent is hereby corrected as shown below:

Column 2, line 27, "manipuration" should read --manipulation--.

Column 4, line 28, "II" should read --arrow II--.

Column 6, line 63, change "222" to --222 and 222'--;

line 64, delete "and 222'".

Column 7, line 43, change "enable" to --to enable--; same line, "access to" should read --access--.

Signed and Sealed this

Sixth Day of September, 1988

*Attest:*

DONALD J. QUIGG

*Attesting Officer*

*Commissioner of Patents and Trademarks*